US009996039B2

(12) United States Patent
Eguchi et al.

(10) Patent No.: US 9,996,039 B2
(45) Date of Patent: Jun. 12, 2018

(54) IMAGE FORMING APPARATUS, IMAGE FORMING METHOD, AND NON-TRANSITORY COMPUTER READABLE MEDIUM

(71) Applicant: FUJI XEROX Co., Ltd., Tokyo (JP)

(72) Inventors: Hirotake Eguchi, Kanagawa (JP); Yasuhiro Kurokawa, Kanagawa (JP); Chihiro Iijima, Kanagawa (JP); Masataka Momma, Kanagawa (JP); Masashi Takahashi, Kanagawa (JP); Shohei Miyagawa, Kanagawa (JP); Kazuyuki Yagata, Kanagawa (JP); Toshihiro Goda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

(21) Appl. No.: 15/345,647

(22) Filed: Nov. 8, 2016

(65) Prior Publication Data

US 2018/0004140 A1 Jan. 4, 2018

(30) Foreign Application Priority Data

Jun. 29, 2016 (JP) ..... 2016-128453

(51) Int. Cl.
*G03G 15/00* (2006.01)

(52) U.S. Cl.
CPC ..... *G03G 15/55* (2013.01); *G03G 15/757* (2013.01)

(58) Field of Classification Search
CPC ..... G03G 15/55; G03G 15/757
See application file for complete search history.

(56) References Cited

U.S. PATENT DOCUMENTS

2011/0052221 A1* 3/2011 Hirobe ..... G03G 15/0877 399/27

FOREIGN PATENT DOCUMENTS

JP 2014-002202 A 1/2014

* cited by examiner

*Primary Examiner* — Hoang Ngo
(74) *Attorney, Agent, or Firm* — Sughrue Mion, PLLC

(57) ABSTRACT

An image forming apparatus includes at least a load unit, a driving unit that drives the load unit, and a controller that controls the driving unit. The controller determines that at least one of the load unit and the driving unit malfunctions if a velocity change time period that the driving unit has taken to reach a second velocity from a first velocity is off a predetermined threshold value.

17 Claims, 8 Drawing Sheets

IMAGE FORMING APPARATUS, IMAGE FORMING METHOD, AND NON-TRANSITORY COMPUTER READABLE MEDIUM

CROSS-REFERENCE TO RELATED APPLICATIONS

This application is based on and claims priority under 35 USC 119 from Japanese Patent Application No. 2016-128453 filed Jun. 29, 2016.

BACKGROUND

Technical Field

The present invention relates to an image forming apparatus, an image forming method, and a non-transitory computer readable medium.

SUMMARY

According to an aspect of the invention, there is provided an information forming apparatus. The information forming apparatus includes at least a load unit, a driving unit that drives the load unit, and a controller that controls the driving unit. The controller determines that at least one of the load unit and the driving unit malfunctions if a velocity change time period that the driving unit has taken to reach a second velocity from a first velocity is off a predetermined threshold value.

BRIEF DESCRIPTION OF THE DRAWINGS

Exemplary embodiments of the present invention will be described in detail based on the following figures, wherein.

DETAILED DESCRIPTION

Exemplary embodiments of the present invention are described with reference to the drawings. The exemplary embodiments are described as examples of an image forming apparatus that embody the spirit of the invention, and are not intended to limit the scope of the invention. The exemplary embodiments are equally applicable to other exemplary embodiments falling in the scope of the invention defined by the claims.

First Exemplary Embodiment

An image forming apparatus 10 including a load unit torque increase detector 100 of a first exemplary embodiment is described below with reference to FIG. 1 and FIG. 2. The image forming apparatus 10 of the first exemplary embodiment includes the load unit torque increase detector 100. The image forming apparatus 10 detects a time period that a motor 118 takes to perform a velocity change. The motor 118 serves as a driving unit driving a load unit 130 including a variety of rollers. The image forming apparatus 10 thus predicts a fault or performs a predictive diagnosis in the motor 118 and the load unit 130.

Figure 1:
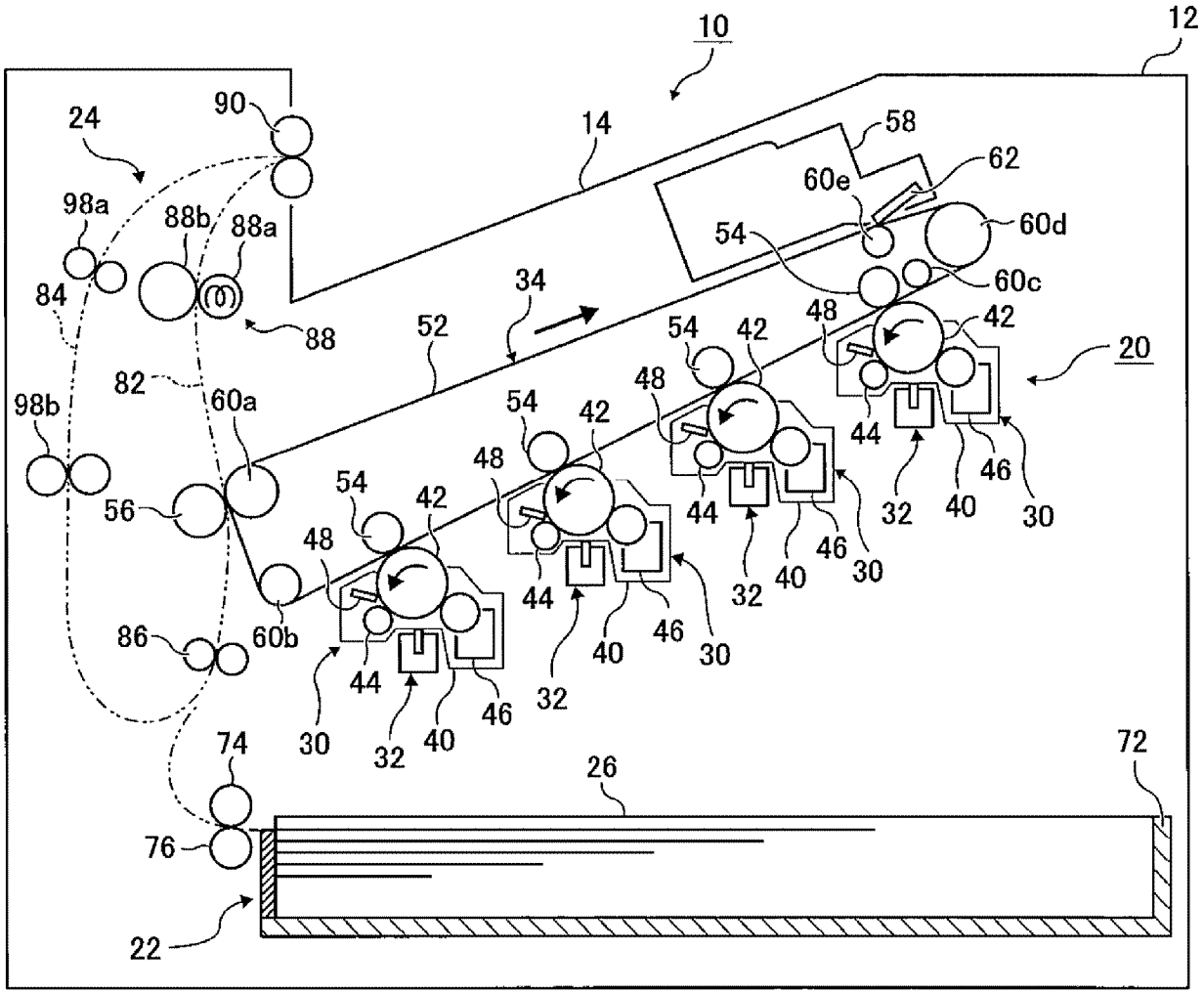
FIG. 1 is a cross-sectional view of an image forming apparatus common to first and second exemplary embodiments.

The image forming apparatus 10 includes an image forming apparatus body 12 as illustrated in FIG. 1. The image forming apparatus body 12 includes on top thereof a discharge unit 14 onto which a recording medium 26 having an image formed thereon is discharged.

The image forming apparatus body 12 includes an opening on the front side (front panel) through which an image forming unit 30 is inserted, and a door (not illustrated) supported on the image forming apparatus body 12 and configured to close the opening. The opening serves as each insertion section of the image forming unit 30, and the image forming unit 30 is inserted through the opening to be mounted.

Mounted in the image forming apparatus body 12 as illustrated in FIG. 1 are an image forming assembly 20, a recording medium feeder 22 that feeds a recording medium 26 to the image forming assembly 20, and a transport path 24 along which the recording medium 26 is transported from the recording medium feeder 22 to the discharge unit 14.

The image forming assembly 20 includes image forming units 30 for yellow (Y), magenta (M), cyan (C), and black (K), optical writing devices 32, and a transfer device 34. The image forming units 30 and the components thereof are identical to each other except for the color of an image to be formed.

The image forming unit 30 is a replacement unit and detachably mounted on the image forming apparatus body 12. The image forming units 30 are mounted in the order of the one for Y, the one for M, the one for C, and the one for K from the back end (left end) of the image forming apparatus body 12.

The image forming unit 30 is an electrophotographic system that forms a color image. Each of the image forming units 30 includes an image forming unit body 40. The image forming unit body 40 includes a photoconductor drum 42 having a developer attached thereon, a charging device 44 serving as a charging unit and having a charging roller that uniformly charges the photoconductor drum 42, a development device 46 that develops a toner image responsive to a latent image written on the photoconductor drum 42 using the developer (toner), and a cleaning device 48 that sweeps the developer remaining on the photoconductor drum 42. The photoconductor drum 42 is disposed to face the optical writing device 32 when the image forming unit 30 is mounted in the image forming apparatus body 12.

Using Y, M, C, and K developers respectively contained therewithin, the development devices 46 develop color images on the corresponding photoconductor drums 42 responsive to latent images formed thereon.

The optical writing devices 32 emit laser light beams in synchronization with a color image signal, and form latent images on the photoconductor drums 42 charged by the charging devices 44. The optical writing device 32 is described in detail below.

The transfer device 34 includes an intermediate transfer belt 52 used as an intermediate transfer body, first transfer rollers 54 used as first transfer devices, a second transfer roller 56 used as a second transfer device, and an cleaning device 58.

The intermediate transfer belt 52 is an endless belt, is entrained about five support rollers 60*a*, 60*b*, 60*c*, 60*d*, and 60*e* in a manner such that the intermediate transfer belt 52 advances in a direction labeled an arrow mark as illustrated in FIG. 1. At least one of the support rollers 60*a*, 60*b*, 60*c*, 60*d*, and 60*e* is connected to the motor 118 (see FIG. 2) that serves as a prime mover. The support roller receiving torque from the motor 118 rotates and drives the intermediate transfer belt 52 in rotation. With the image forming units 30 mounted in the image forming apparatus body 12, the photoconductor drum 42 of the image forming unit 30 is placed into contact with the intermediate transfer belt 52.

The support roller 60*a* is rotatably supported to face the second transfer roller 56, and thus functions as a backup roller for the second transfer roller 56. The nip between the second transfer roller 56 and the support roller 60*a* serves as a second transfer position.

The first transfer rollers 54 transfer onto the intermediate transfer belt 52 developer images formed on the surfaces of the photoconductor drums 42 by the development devices 46.

The second transfer roller 56 transfers the Y, M, C, and K developer images transferred onto the intermediate transfer belt 52 to a recording medium.

After each of the developer images is transferred onto the recording medium by the second transfer roller 56, the cleaning device 58, including a sweeping member 62 that sweeps across the surface of the intermediate transfer belt 52, removes the remaining developer of each color. The developers removed by the sweeping member 62 is recollected into the body of the cleaning device 58.

The recording medium feeder 22 includes a recording medium tray 72, a transport roller 74, and a retard roller 76. The recording medium tray 72 holds the recording media in a stacked state. The transport roller 74 picks up the top recording medium of the stack in the recording medium tray 72 and transports the picked up recording medium to the image forming assembly 20. The retard roller 76 separates one recording medium from the other and avoids transporting multiple recording media in a stacked state to the image forming assembly 20.

The transport path 24 includes a forward transport path 82 and a reverse transport path 84.

The forward transport path 82 transports the recording medium supplied from the recording medium feeder 22 to the image forming assembly 20, and the recording medium having an image formed thereon is discharged to the discharge unit 14. Disposed along the forward transport path 82 are the transport roller 74, retard roller 76, registration rollers 86, transfer device 34, fixing device 88, and discharge rollers 90 in the order from the upstream side of a recording medium transport direction.

The registration rollers 86 temporarily halt the movement of the recording medium transported from the recording medium feeder 22 at the leading edge thereof and then starts transporting the recording medium again toward the transfer device 34 in a manner such that the transportation of the recording medium is synchronized with the image forming timing.

The fixing device 88, including a heating roller 88*a* and a pressure roller 88*b*, heats and presses the recording medium passing between the heating roller 88*a* and the pressure roller 88*b*, thereby fixing the developer image onto the recording medium.

The discharge rollers 90 discharge the recording medium with the developer fixed thereon by the fixing device 88 to the discharge unit 14.

The reverse transport path 84 transports the recording medium toward the image forming assembly 20 while reversing the page of the recording medium having the developer image to the back page. The reverse transport path 84 includes two pairs of reverse transport rollers 98*a* and 98*b*.

The recording medium is transported along the forward transport path 82 to the discharge rollers 90, and the discharge rollers 90 rotate reversely with the trailing edge portion of the recording medium engaged between the discharge rollers 90. The recording medium reaches the reverse transport path 84. The recording medium placed on the reverse transport path 84 is then transported upstream of the registration rollers 86 by reverse transport rollers 98*a* and 98*b*.

Figure 2:
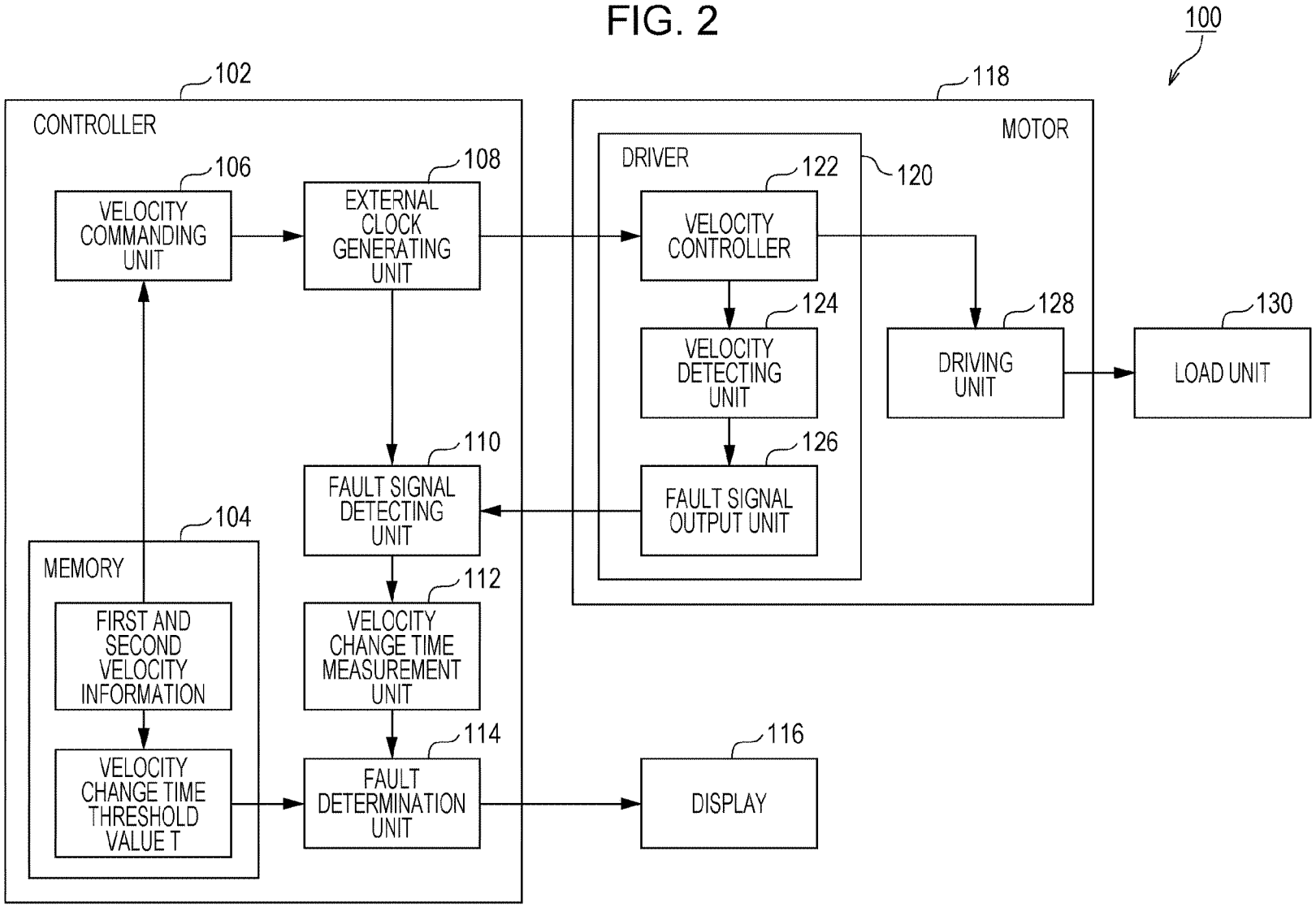
FIG. 2 is a block diagram illustrating a configuration of a load unit torque increase detector common to the first and second exemplary embodiments.
Figure 3:
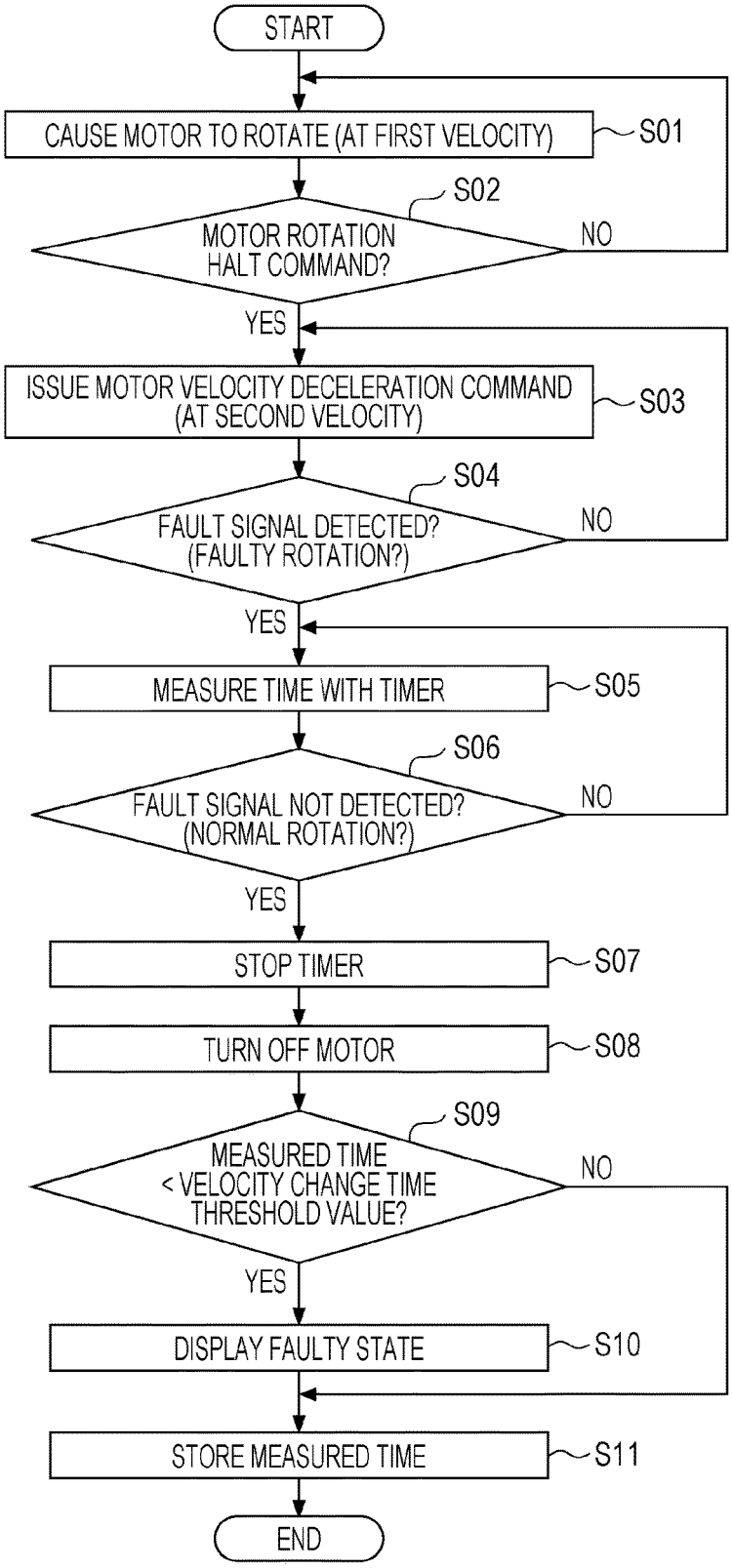
FIG. 3 is a flowchart illustrating the load unit torque increase detector of the first exemplary embodiment.

Referring to FIG. 2, the load unit torque increase detector 100 in the image forming apparatus 10 of the first exemplary embodiment is described.

The load unit torque increase detector 100 includes a controller 102, such as a CPU in the image forming apparatus body 12, and a direct-current (DC) motor 118 (hereinafter simply referred to as a motor 118) including the driver 120 to be controlled by the controller 102. The motor 118 serves a prime mover and includes a driving unit 128 driving the load unit 130 in the image forming apparatus body 12.

The load unit 130 to be driven by the motor 118 may include the transport roller 74, the retard roller 76, the registration rollers 86, the discharge rollers 90, and a variety of rollers disposed in the transfer device 34, and the fixing device 88. The load unit torque increase detector 100 thus predicts a fault or performs fault prognosis on the load 130 and the motor 118 driving the load unit 130.

The controller 102 in the load unit torque increase detector 100 includes a memory 104, such as a read-only memory (ROM) and a random-access memory (RAM). The memory 104 stores first velocity information and second velocity information concerning velocities of the motor 118, and a velocity change time threshold value T that serves as a reference when the motor 118 changes from a first velocity V1 to a second velocity V2 in a normal operating condition.

The first velocity V1 stored as the first velocity information is a velocity at which the motor 118 drives the load unit 130 in a normal operating condition. The second velocity V2 stored as the second velocity information is a velocity to which the first velocity V1 is changed before the motor 118 is halted.

The controller 102 includes a velocity commanding unit 106 that instructs the motor 118 to rotate at a driving velocity in response to the first velocity information and the second velocity information stored on the memory 104. In response to a velocity command from the velocity commanding unit 106, an external clock generating unit 108 transmits a velocity control signal (clock pulse) to a driver 120 in the motor 118.

The velocity control signal from the external clock generating unit 108 is transmitted to a velocity controller 122 in the driver 120 in the motor 118 and then controls the rotational velocity of the driving unit 128. The driving unit 128 rotating at a controlled rotational velocity drives the load unit 130. The driving unit 128 applies torque to the load unit 130.

The driver 120 in the motor 118 includes a velocity detecting unit 124 that detects the rotational velocity of the driving unit 128. The driver 120 also includes a fault signal output unit 126. If there occurs a faulty state that the driving unit 128 in the motor 118 rotates at a rotational velocity different from a rotational velocity indicated by a command issued by the velocity commanding unit 106, the fault signal output unit 126 outputs a fault signal (fail signal) indicating faulty rotation.

A rotatably supported cylindrical rotor of the motor 118 having an NS alternately magnetized segments on the lower side thereof with N pole segments and S pole segments alternately arranged rotates over a board having a frequency generator (FG) rectangular pattern (comb-like wire rectangular pattern) having the same number of magnetized poles as the rotor. The number of rotations is detected from a voltage generated by the FG rectangular pattern. If the detected number of rotations falls outside a range of ±6.25% of the rotational velocity of the command, a fault signal is detected.

The controller 102 includes a fault signal detecting unit 110. The fault signal detecting unit 110 detects a fault signal if the fault signal output unit 126 in the motor 118 outputs the fault signal. If the motor 118 is in a normal operating condition, no fault signal is output (detected). The motor 118 is thus determined to be operating in a normal operating condition.

The controller 102 includes a velocity change time measurement unit 112. The velocity change time measurement unit 112 measures a time period the motor 118 takes to change the velocity thereof from the first velocity V1 to the second velocity V2. The change from the first velocity V1 to the second velocity V2 is measured by measuring a change time period responsive to a deceleration time period or an acceleration time period. The measurement of the change time period begins when the fault signal detecting unit 110 in the controller 102 detects a fault signal output from the fault signal output unit 126 with the motor 118 operating in the faulty operating condition. If the faulty rotation changes to normal rotation with no fault signal detected any longer, the time measurement stops. Since the motor 118 itself performs this operation with its own components, an external encoder is not used.

The memory 104 in the controller 102 stores a velocity change time threshold value T. The velocity change time threshold value T serves as a reference range of the change time period the motor 118 takes to change from the first velocity V1 to the second velocity V2 in a normal operating condition. The velocity change time threshold value T may be set up depending on whether the motor 118 is decelerating or accelerating, or depending on the driving unit 128 or the load unit 130 driven by the driving unit 128. The velocity change time threshold value during the deceleration may be referred to as a deceleration time period threshold value, and the velocity change time threshold value during the acceleration may be referred to as an acceleration time period threshold value.

The controller 102 includes a fault determination unit 114. The fault determination unit 114 compares the velocity change time period measured by the velocity change time measurement unit 112 (also referred to as a measurement time period) with the velocity change time threshold value T stored on the memory 104, thereby identifying a fault in the motor 118. If the measured velocity change time period fails to agree with the velocity change time threshold value T, the fault determination unit 114 determines that the motor 118 malfunctions.

If the fault determination unit 114 determines that the motor 118 or the load unit 130 malfunctions, the image forming apparatus 10 displays an indication of a fault on the display 116, such as a liquid-crystal display. The measured velocity change time period is stored on the memory 104.

Referring to FIG. 2 through FIG. 5, the load unit torque increase detector 100 of the first exemplary embodiment is described.

Figure 4:
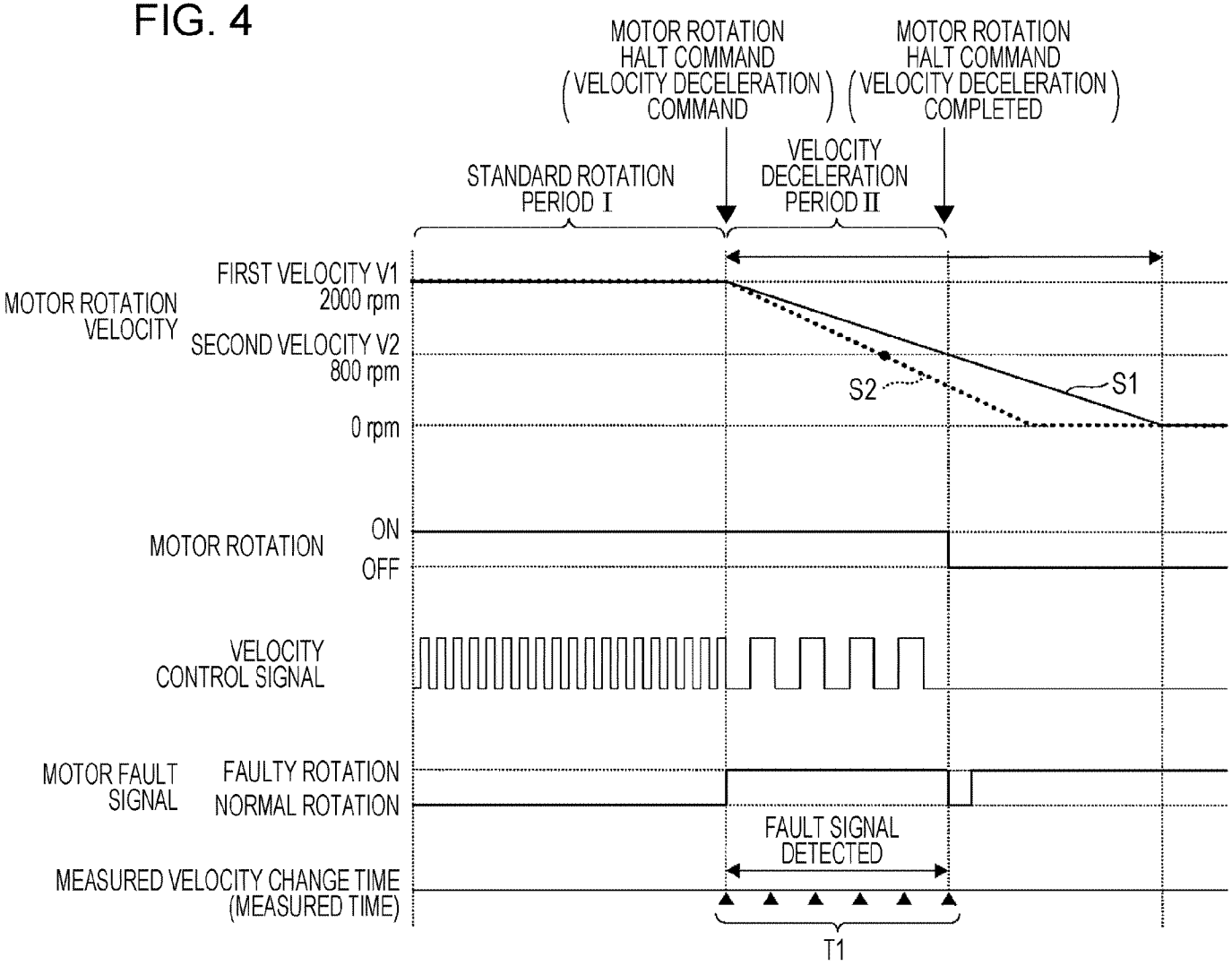
FIG. 4 is a graph illustrating the load unit torque increase detection of the first exemplary embodiment in a normal operating condition.
Figure 5:
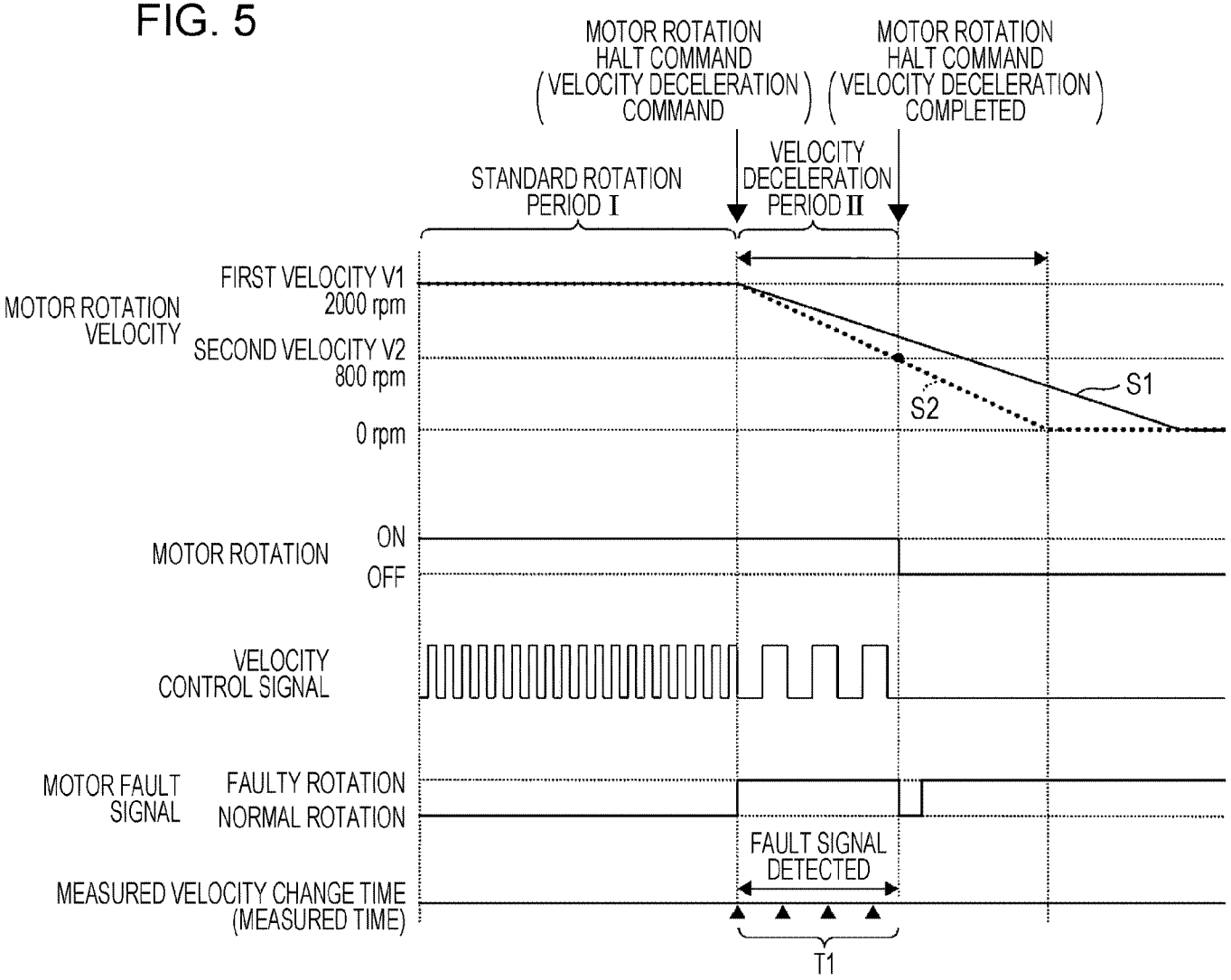
FIG. 5 is a graph illustrating the load unit torque increase detection of the first exemplary embodiment in a faulty operating condition.
Figure 6:
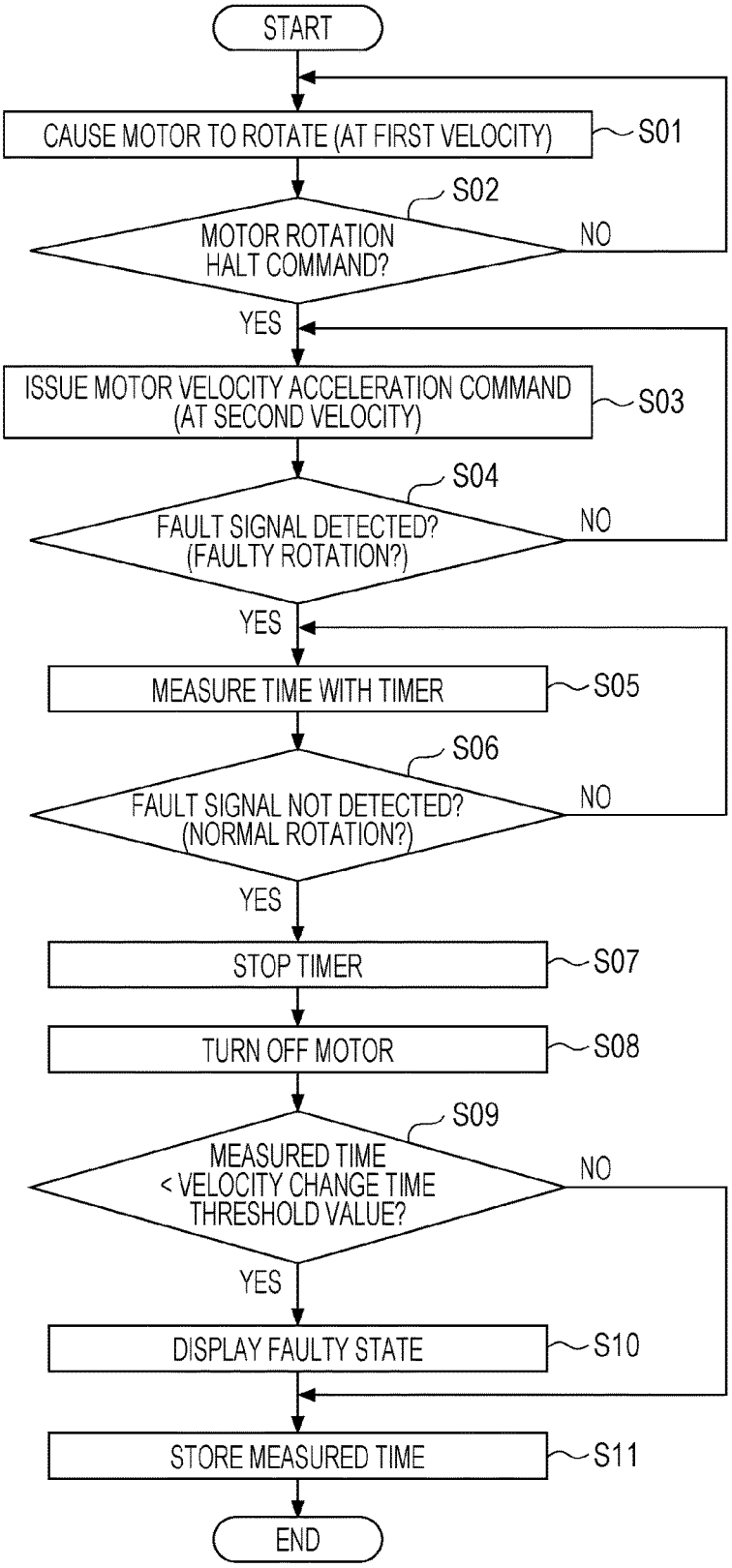
FIG. 6 is a flowchart illustrating the load unit torque increase detector of the second exemplary embodiment.

Concerning the number of rotations of the motor 118 in the first exemplary embodiment, the first velocity V1 representing the first velocity information may now be 2000 rpm, and the second velocity V2 representing the second velocity information may now be 800 rpm. A rise in the load unit torque is detected when the motor 118 is decelerated from the first velocity V1 to the second velocity V2. FIG. 4 illustrates a velocity deceleration period of the motor 118 in a normal operating condition. FIG. 5 illustrates a velocity deceleration period of the motor 118 in a faulty operating condition.

In order to operate the motor 118 in a normal operating condition, the velocity commanding unit 106 in the controller 102 issues a command to cause the driving unit 128 to rotate at 2000 rpm as the first velocity V1 in response to the first velocity information. In response to the command, the external clock generating unit 108 sends a velocity control signal to the velocity controller 122 in the driver 120 in the motor 118. The driving unit 128 thus rotates at 2000 rpm as the first velocity V1, thereby driving the load unit 130 (step S01).

In graphs of FIG. 4 and FIG. 5, the motor 118 normally operates during a standard operation period I without outputting a fault signal.

It is then determined whether a halt command has been issued to the motor 118 (step S02). If no halt command has been issued, the motor 118 rotates at the first velocity V1 (no branch from step S02).

If a halt command to halt the motor 118 has been issued (yes branch from step S02), the velocity commanding unit 106 in the controller 102 outputs a command to decelerate the driving unit 128 in the motor 118. More specifically, the velocity commanding unit 106 in the controller 102 issues the command to cause the driving unit 128 to rotate at 800 rpm as the second velocity V2. The external clock generating unit 108 sends a velocity control signal to the velocity controller 122 in the driver 120 in the motor 118. The driving unit 128 thus rotates at 800 rpm (step S03). At this moment, a velocity deceleration period II begins as illustrated in FIG. 4 and FIG. 5.

The fault signal detecting unit 110 in the controller 102 determines whether the motor 118 has output a fault signal (step S04).

As illustrated in the graphs of FIG. 4 and FIG. 5, the motor 118 is controlled to rotate at 800 rpm as the second velocity V2 during the velocity deceleration period II. There is a time lag before the motor 118 is actually decelerated. A fault signal indicating faulty rotation is output before the driving unit 128 rotates at 800 rpm. The driving unit 128 decelerates under resistance from the load unit 130.

If the fault signal detecting unit 110 detects a fault signal output from the fault signal output unit 126 (yes branch from step S04), the velocity change time measurement unit 112 starts measuring time (with a timer) throughout which the fault signal is detected by the velocity change time measurement unit 112 (step S05). If no fault signal is detected, the detection of a fault signal is repeated (no branch from step S04).

It is determined whether the motor 118 normally rotates while the motor 118 is decelerating (step S06). The normal rotation is determined in response to the fact that the fault signal from the motor 118 is no longer detected. More specifically, when the number of rotations of the driving unit 128 in the motor 118 that is in the middle of deceleration is 800 rpm as the second velocity V2, the velocity of the motor 118 matches a velocity indicated by the velocity command from the velocity commanding unit 106. The faulty rotation reverts back to the standard rotation. The fault signal is no longer output and is thus undetected.

If it is determined that the motor 118 is in the standard rotation with the fault signal no longer detected (yes branch from step S06), the velocity change time measurement unit 112 stops measuring time to detect the fault signal (with the timer turned off) (step S07). In this case, a time period that the velocity change time measurement unit 112 has measured since the detection of the fault signal is a velocity change time period (measured time) T1. The time period throughout which the fault signal is detected is stored on the memory 104.

While the motor 118 is not normally rotating, the measurement of the time from the detection of the fault signal continues (no branch from step S06).

Upon receiving a halt command, the motor 118 stops rotating at the second velocity V2 (step S08). In response to the halt command as illustrated in FIG. 4 and FIG. 5, the motor 118 continues to rotate by inertia and the fault signal is output until the motor 118 comes to a halt (0 rpm). The halt command may be triggered in response to the switching of the motor 118 to the standard rotation at the second velocity V2 when the fault signal is no longer detected. In this way, triggering the halt command does not involve another mechanism or another device.

The fault determination unit 114 in the controller 102 compares the velocity change time threshold value T serving as a reference on the normally operating motor 118 stored on the memory 104 with the velocity change time period T1 throughout which the velocity change time measurement unit 112 detects the fault signal (step S09). Since the motor 118 is decelerated from the first velocity V1 to the second velocity V2 in accordance with the first exemplary embodiment, the comparison with a velocity change time threshold value T during deceleration is performed. The velocity change time period T1 measured by the velocity change time measurement unit 112 is thus compared with the velocity change time threshold value T serving as a standard reference stored on the memory 104. If the measured velocity change time period T1 is shorter than the velocity change time threshold value T, it is thus determined that the load unit 130 or the motor 118 malfunction (yes branch from step S09).

When the motor 118 is decelerated from the first velocity V1 to the second velocity V2, a deceleration velocity S2 of a faulty motor represented by a broken line in FIG. 5 is higher in rate of change than a deceleration velocity S1 of a normal motor represented by a solid line in FIG. 4. A time period taken to change the velocity from the first velocity V1 to the second velocity V2 is shorter. Since the velocity change time period T1 measured as illustrated in FIG. 4 falls within the range of the velocity change time threshold value T, it is determined that no fault has occurred (the motor 118 is in a normal operating condition). The velocity change time period T1 measured as illustrated in FIG. 5 is shorter than the velocity change time threshold value T, and the motor 118 is determined to malfunction.

Before the motor 118 comes to a halt, the time period taken by the motor 118 to decelerate from the first velocity V1 to the second velocity V2 becomes shorter as represented by a deceleration velocity S2 of a faulty motor 118 indicated by the broken line in FIG. 5. The load unit 130 may have a heavier workload than in a normal operation or the operation thereof may be interfered with contacting from an external member. The motor 118 may be involved in more torque, and decelerate more quickly. For this reason, fault prediction and predictive diagnosis may be performed, based on the premise that the load unit 130 malfunction. The motor 118, if malfunctioning, may not properly respond to torque the driving unit 128 receives from the load unit 130, or the driver 120 may not be properly controlled, in comparison with the normal operation. The fault prediction or predictive diagnosis may be performed on the motor 118.

If the fault determination unit 114 determines that the load unit 130 or the motor 118 malfunctions (yes branch from step S09), the display 116 in the image forming apparatus 10 displays an indication of the fault (step S10). The velocity change time period T1 measured is stored on the memory 104 (step S11).

If the comparison of the measured velocity change time period T1 with the velocity change time threshold value T indicates no fault (no branch from step S09), the measured velocity change time period T1 is stored on the memory 104 (step S11)

The load unit torque increase detection of the first exemplary embodiment is thus complete.

Second Exemplary Embodiment

The load unit torque increase detection of a second exemplary embodiment is described with reference to FIG. 2, and FIG. 6 through FIG. 8. The load unit torque increase detection of the first exemplary embodiment is performed when the motor 118 is decelerated from the first velocity V1 to the second velocity V2. In accordance with the second exemplary embodiment, the motor 118 is accelerated from the first velocity V1' to the second velocity V2'.

The load unit torque increase detection of the second exemplary embodiment is different from the load unit torque increase detection of the first exemplary embodiment in terms of part of a control method. Elements identical to those of the first exemplary embodiment are designated with the same reference numerals and the detailed discussion thereof is omitted herein.

Figure 7:
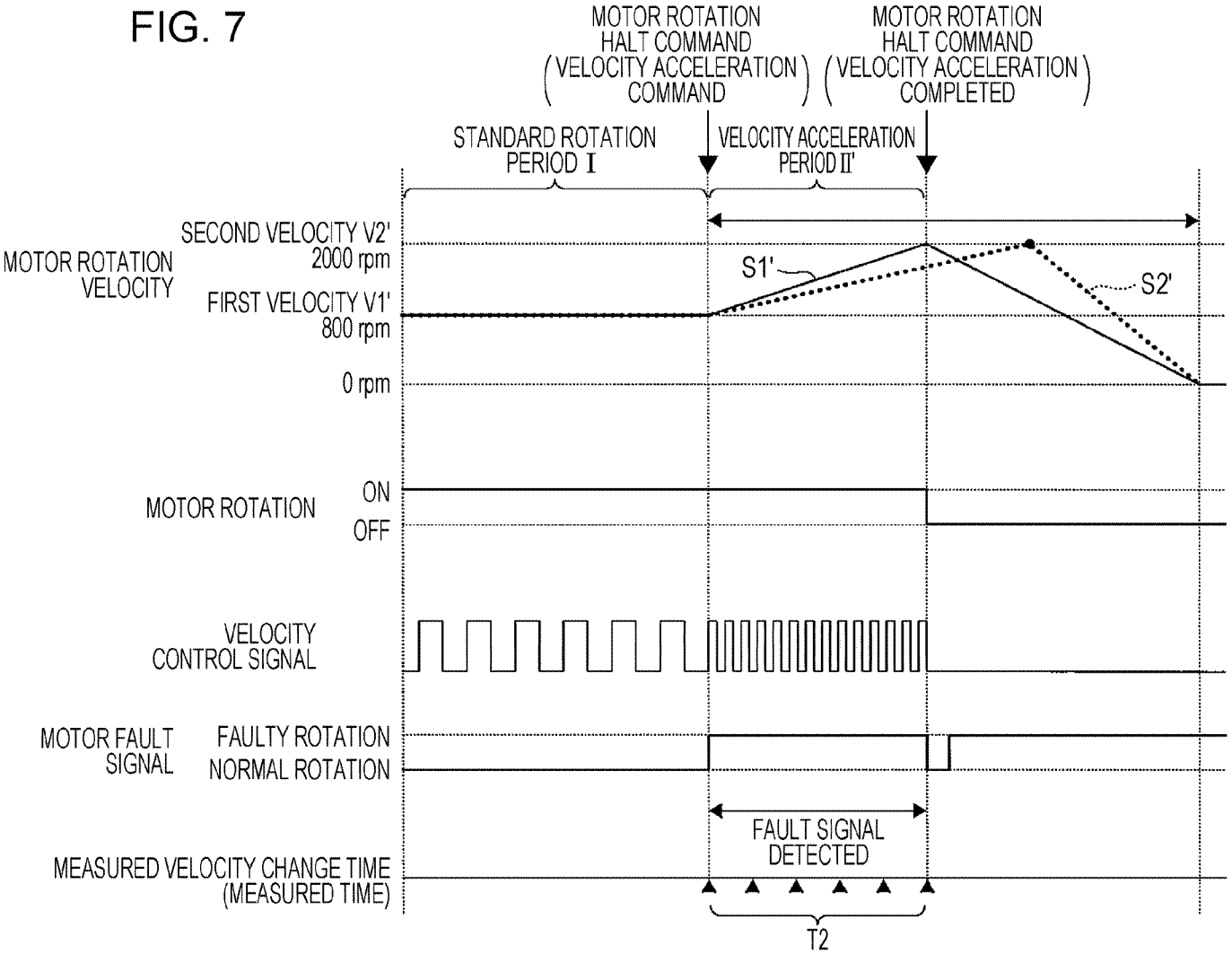
FIG. 7 is a graph illustrating the load unit torque increase detection of the second exemplary embodiment in a normal operating condition.
Figure 8:
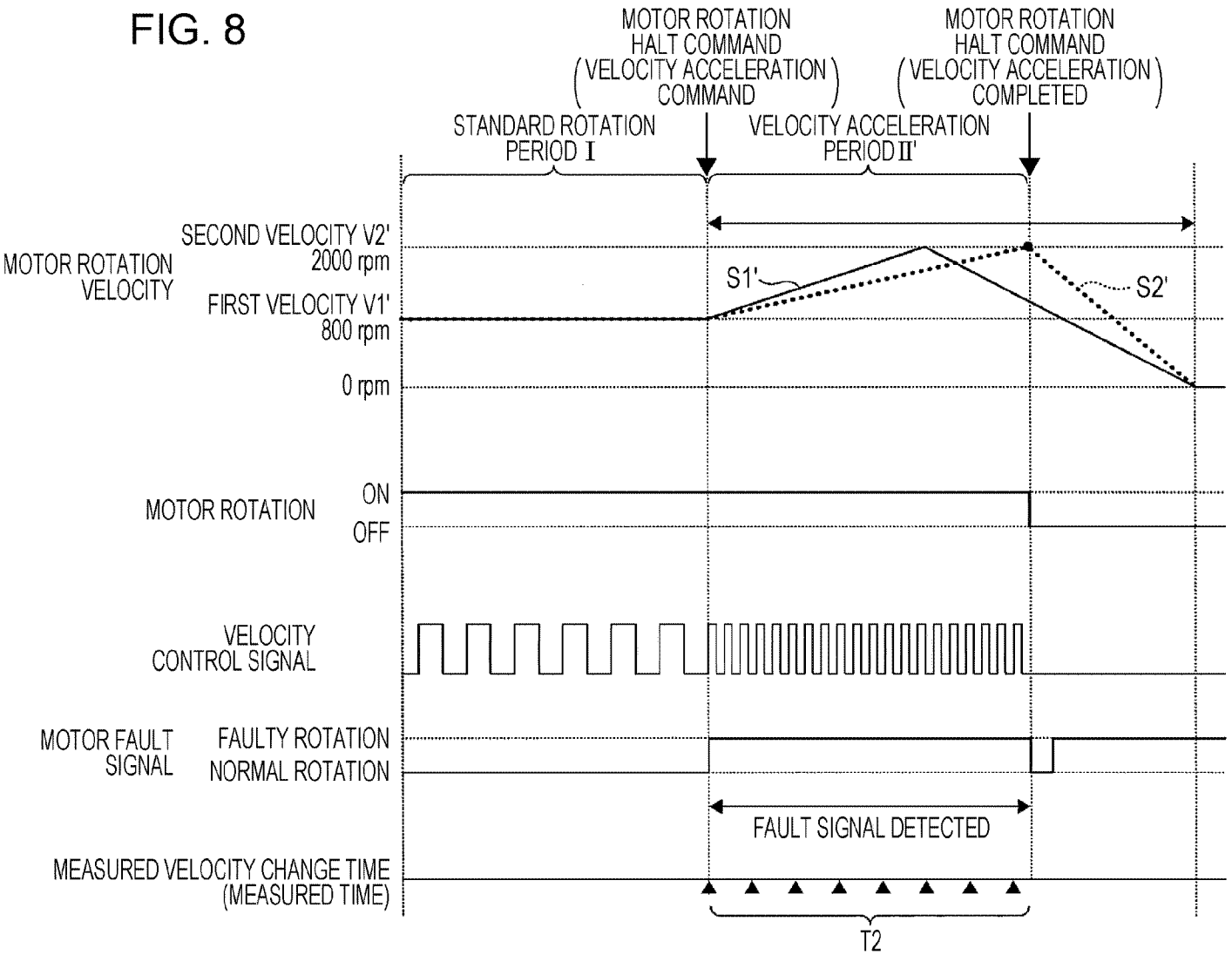
FIG. 8 is a graph illustrating the load unit torque increase detection of the second exemplary embodiment in a faulty operating condition.

Concerning the rotational velocity of the motor 118 in the load unit torque increase detection performed by the load unit torque increase detector 100 in the image forming apparatus 10 of the second exemplary embodiment, the first velocity V1' may be 800 rpm as the first velocity information and the second velocity V2' may be 2000 rpm as the second velocity information higher than the first velocity V1', and these pieces of information are stored on the controller 102 of FIG. 2. The load unit torque increase detection is performed when the motor 118 is accelerated from the first velocity V1' to the second velocity V2'. FIG. 7 illustrates an acceleration time period of the motor 118 in a normal operating condition. FIG. 8 illustrates an acceleration time period of the motor 118 in a faulty operating condition.

In order to operate the motor 118 in a normal operating condition, the velocity commanding unit 106 in the controller 102 issues a command to cause the driving unit 128 to rotate at 800 rpm as the first velocity V1' in response to the first velocity information. In response to the command, the external clock generating unit 108 sends a velocity control signal to the velocity controller 122 in the driver 120 in the motor 118. The driving unit 128 thus rotates at 800 rpm as the first velocity V1', thereby driving the load unit 130 (step S01).

In graphs of FIG. 7 and FIG. 8, the motor 118 normally operates during a standard operation period I without outputting a fault signal.

It is then determined whether a halt command has been issued to the motor 118 (step S02). If no halt command has been issued, the motor 118 rotates at the first velocity V1' (no branch from step S02).

If a halt command to halt the motor 118 has been issued (yes branch from step S02), the velocity commanding unit 106 in the controller 102 outputs a command to accelerate the driving unit 128 in the motor 118. More specifically, the velocity commanding unit 106 in the controller 102 issues the command to cause the driving unit 128 to rotate at 2000 rpm as the second velocity V2'. The external clock generating unit 108 sends a velocity control signal to the velocity controller 122 in the driver 120 in the motor 118. The driving unit 128 thus rotates at 2000 rpm (step S03). At this moment, a velocity acceleration period II' begins as illustrated in FIG. 7 and FIG. 8.

The fault signal detecting unit 110 in the controller 102 determines whether the motor 118 has output a fault signal (step S04).

As illustrated in the graphs of FIG. 7 and FIG. 8, the motor 118 is controlled to rotate at 2000 rpm as the second velocity V2' during the velocity acceleration period II'. There is a time lag before the motor 118 is actually accelerated. A fault signal indicating faulty rotation is output before the driving unit 128 rotates at 2000 rpm. The driving unit 128 accelerates under resistance from the load unit 130.

If the fault signal detecting unit 110 detects a fault signal output from the fault signal output unit 126 (yes branch from step S04), the velocity change time measurement unit 112 starts measuring time (with a timer) throughout which the fault signal is detected by the velocity change time measurement unit 112 (step S05). If no fault signal is detected, the detection of a fault signal is repeated (no branch from step S04).

It is determined whether the motor 118 normally rotates while the motor 118 is accelerating (step S06). The normal rotation is determined in response to the fact that the fault signal from the motor 118 is no longer detected. More specifically, when the number of rotations of the driving unit 128 in the motor 118 that is in the middle of acceleration is 2000 rpm as the second velocity V2', the velocity of the motor 118 matches a velocity indicated by the velocity command from the velocity commanding unit 106. The faulty rotation reverts back to the standard rotation. The fault signal is no longer output and is thus undetected.

If it is determined that the motor 118 is in the standard rotation with the fault signal no longer detected (yes branch from step S06), the velocity change time measurement unit 112 stops measuring time to detect the fault signal (with the timer turned off) (step S07). In this case, a time period that the velocity change time measurement unit 112 has measured since the detection of the fault signal is a velocity change time period (measured time) T2. The time period throughout which the fault signal is detected is stored on the memory 104.

While the motor 118 is not normally rotating, the measurement of the time from the detection of the fault signal continues (no branch from step S06).

Upon receiving a halt command, the motor 118 stops rotating at the second velocity V2' (step S08). In response to the halt command as illustrated in FIG. 7 and FIG. 8, the motor 118 continues to rotate by inertia and the fault signal is output until the motor 118 comes to a halt (0 rpm). The halt command may be triggered in response to the switching of the motor 118 to the standard rotation at the second velocity V2' when the fault signal is no longer detected. In this way, triggering the halt command does not involve another mechanism or another device.

The controller 102 compares the velocity change time threshold value T serving as a reference on the normally operating motor 118 stored on the memory 104 with the velocity change time period T2 throughout which the velocity change time measurement unit 112 detects the fault signal (step S09). Since the motor 118 is accelerated from the first velocity V1' to the second velocity V2' in accordance with the second exemplary embodiment, the comparison with a velocity change time threshold value T during acceleration is performed. The velocity change time period T2 measured by the velocity change time measurement unit 112 is thus compared with the velocity change time threshold value T serving as a standard reference stored on the memory 104. If the measured velocity change time period T2 is longer than the velocity change time threshold value T, it is thus determined that the load unit 130 or the motor 118 malfunction (yes branch from step S09).

When the motor 118 is accelerated from the first velocity V1' to the second velocity V2', an acceleration velocity S2' of a faulty motor represented by a broken line in FIG. 8 is lower in rate of change than an acceleration velocity S1' of a normal motor represented by a solid line in FIG. 7. A time period taken to change the velocity from the first velocity V1' to the second velocity V2' is longer. Since the velocity change time period T2 measured as illustrated in FIG. 7 falls within the range of the velocity change time threshold value T, it is determined that no fault has occurred (the motor 118 is in a normal operating condition). The velocity change time period T2 measured as illustrated in FIG. 8 is longer than the velocity change time threshold value T, and the motor 118 is determined to malfunction.

Before the motor 118 comes to a halt, the time period taken by the motor 118 to accelerate from the first velocity V1' to the second velocity V2' becomes longer as represented by an acceleration velocity S2' of a faulty motor 118 indicated by the broken line in FIG. 8. The load unit 130 may have a heavier workload than in a normal operation or the operation thereof may be interfered with contacting from an external member. The motor 118 may be involved in more torque, and accelerates more slowly. For this reason, fault prediction and predictive diagnosis may be performed, based on the premise that the load unit 130 malfunction. The motor 118, if malfunctioning, may not properly respond to torque the driving unit 128 receives from the load unit 130, or the driver 120 may not be properly controlled, in comparison with the normal operation. The fault prediction or predictive diagnosis may be performed on the motor 118.

If the fault determination unit 114 determines that the load unit 130 or the motor 118 malfunctions (yes branch from step S09), the display 116 in the image forming apparatus 10 displays an indication of the fault (step S10). The velocity change time period T2 measured is stored on the memory 104 (step S11).

If the comparison of the measured velocity change time period T2 with the velocity change time threshold value T indicates no fault (no branch from step S09), the measured velocity change time period T2 is stored on the memory 104 (step S11).

The load unit torque increase detection of the second exemplary embodiment is thus complete.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a load unit;

a driving unit configured to drive the load unit; and a controller configured to control the driving unit, wherein the controller is configured to determine that at least one of the load unit and the driving unit malfunctions if a velocity change time period that the driving unit has taken to reach a second velocity from a first velocity differs from a predetermined threshold value, and wherein the controller is configured to set up a time period throughout which the driving unit drives at the second velocity, during a transitional time period from a state with the driving unit driving at the first velocity to a halt state with the driving unit halted, and to measure the velocity change time period from the first velocity to the second velocity.

2. The image forming apparatus according to claim 1, wherein the image forming apparatus is configured to output a fault signal if the driving unit drives at a velocity different from the first velocity and the second velocity which the controller has instructed the driving unit to drive at, and wherein the controller is configured to determine, by detecting switching between outputting and not outputting of the fault signal, that the second velocity has been reached from the first velocity.

3. The image forming apparatus according to claim 2, wherein the controller is configured to halt the driving unit if the switching between outputting and not outputting of the fault signal is detected in response to the second velocity being reached by the driving unit from the first velocity.

4. The image forming apparatus according to claim 3, wherein the second velocity is lower than the first velocity.

5. The image forming apparatus according to claim 3, wherein the second velocity is higher than the first velocity.

6. The image forming apparatus according to claim 2, wherein the second velocity is lower than the first velocity.

7. The image forming apparatus according to claim 2, wherein the second velocity is higher than the first velocity.

8. The image forming apparatus according to claim 1, wherein the second velocity is lower than the first velocity.

9. The image forming apparatus according to claim 1, wherein the second velocity is higher than the first velocity.

10. An image forming apparatus comprising:

a load unit;

a driving unit configured to drive the load unit; and a controller configured to control the driving unit, wherein the controller is configured to determine that at least one of the load unit and the driving unit malfunctions if a velocity change time period that the driving unit has taken to reach a second velocity from a first velocity differs from a predetermined threshold value, wherein the image forming apparatus is configured to output a fault signal if the driving unit drives at a velocity different from the first velocity and the second velocity which the controller has instructed the driving unit to drive at, and wherein the controller is configured to determine, by detecting switching between outputting and not outputting of the fault signal, that the second velocity has been reached from the first velocity.

11. The image forming apparatus according to claim 10, wherein the controller is configured to halt the driving unit if the switching between the outputting and not outputting of the fault signal is detected in response to the second velocity being reached by the driving unit from the first velocity.

12. The image forming apparatus according to claim 11, wherein the second velocity is lower than the first velocity.

13. The image forming apparatus according to claim 11, wherein the second velocity is higher than the first velocity.

14. The image forming apparatus according to claim 10, wherein the second velocity is lower than the first velocity.

15. The image forming apparatus according to claim 10, wherein the second velocity is higher than the first velocity.

16. An image forming method comprising:

driving a load unit; and controlling a driving unit, wherein the controlling determines that at least one of the load unit and the driving unit malfunctions if a velocity change time period that the driving unit has taken to reach a second velocity from a first velocity differs from a predetermined threshold value, wherein the controlling sets up a time period throughout which the driving unit drives at the second velocity, during a transitional time period from a state with the driving unit driving at the first velocity to a halt state with the driving unit halted, and measures the velocity change time period from the first velocity to the second velocity.

17. A non-transitory computer readable medium storing a program causing a computer to execute a process for forming an image, the process comprising:

driving a load unit; and controlling a driving unit, wherein the controlling determines that at least one of the load unit and the driving unit malfunctions if a velocity change time period that the driving unit has taken to reach a second velocity from a first velocity differs from a predetermined threshold value, wherein the controlling sets up a time period throughout which the driving unit drives at the second velocity, during a transitional time period from a state with the driving unit driving at the first velocity to a halt state with the driving unit halted, and measures the velocity change time period from the first velocity to the second velocity.

* * * * *